US008950939B2

(12) United States Patent
Last et al.

(10) Patent No.: US 8,950,939 B2
(45) Date of Patent: Feb. 10, 2015

(54) CLOSURE ASSEMBLY AND A COLLAPSIBLE POUCH CONTAINER PROVIDED WITH A CLOSURE ASSEMBLY

(71) Applicant: IPN IP B.V., Houten (NL)

(72) Inventors: Laurens Last, Bosch EnDuin (NL); Paul van den Hoonaard, Peachtree City, GA (US)

(73) Assignee: IPN IP B.V., Houten (NL)

( * ) Notice: Subject to any disclaimer, the term of this patent is extended or adjusted under 35 U.S.C. 154(b) by 99 days.

(21) Appl. No.: 13/930,805

(22) Filed: Jun. 28, 2013

(65) Prior Publication Data

US 2014/0010481 A1 Jan. 9, 2014

Related U.S. Application Data

(60) Provisional application No. 61/669,744, filed on Jul. 10, 2012.

(51) Int. Cl.

| | |
|---|---|
| ***B65D 33/14*** | (2006.01) |
| ***B65D 33/16*** | (2006.01) |
| ***B65D 39/00*** | (2006.01) |
| ***B65D 35/00*** | (2006.01) |
| ***B65D 41/04*** | (2006.01) |

(Continued)

(52) U.S. Cl.

CPC ..... *B65D 41/04* (2013.01); *B65D 75/5883* (2013.01); *B65D 41/3409* (2013.01); *B65D 2101/0046* (2013.01); *B65D 2575/583* (2013.01); *B65D 2575/586* (2013.01)

USPC ..... 383/5; 363/80; 215/252; 222/92

(58) Field of Classification Search

USPC ..... 215/252; 222/92; 383/5, 80

See application file for complete search history.

(56) References Cited

U.S. PATENT DOCUMENTS 4,305,516 A * 12/1981 Perne et al. ..... 215/252
7,753,233 B2 * 7/2010 Umenaka ..... 222/107

(Continued)

FOREIGN PATENT DOCUMENTS

EP 0511502 A2 4/1992
JP 2004331124 A * 11/2004 ..... B65D 41/34

(Continued)

OTHER PUBLICATIONS

Search Report dated Feb. 21, 2013 for priority Netherlands Application NL 2009109.

*Primary Examiner* — Jes F Pascua

(74) *Attorney, Agent, or Firm* — Troutman Sanders LLP; Ryan A. Schneider

(57) ABSTRACT

A closure assembly comprising an article with a neck and a cap. The cap includes a tamper-evident ring having at least two ring segments, each ring segment having a base portion and an indicator portion. The article has for each segment a boss with a catch portion having a recess. Upon rotating the cap in an opening direction by the user from its closed position for the first time the head end of the indicator portion enters the recess of the catch portion and is then prevented from further rotation of the cap in opening direction, while the catch portion outer wall comes in the spacing between the spaced apart head end and trailing end, the frangible bridge between the head end and trailing end breaking and the indicator portion bending, folding, and/or buckling while being subjected to permanent deformation upon further rotation of the cap in opening direction.

21 Claims, 16 Drawing Sheets

(51) Int. Cl.
*B65D 75/58* (2006.01)
*B65D 41/34* (2006.01)

(56) References Cited

U.S. PATENT DOCUMENTS 8,443,999 B1 * 5/2013 Reinders ..... 220/303
8,528,757 B2 * 9/2013 Bisio ..... 215/252
8,807,361 B2 * 8/2014 Luo ..... 215/252
2009/0223963 A1 9/2009 Bisio

FOREIGN PATENT DOCUMENTS

WO 2009000342 A1 12/2008
WO 2012044166 A1 4/2012

* cited by examiner

CLOSURE ASSEMBLY AND A COLLAPSIBLE POUCH CONTAINER PROVIDED WITH A CLOSURE ASSEMBLY

CROSS-REFERENCE TO RELATED APPLICATIONS

This application claims the benefit of U.S. Provisional Application No. 61/669,744 filed 10 Jul. 2012, and NL 2009109 filed 3 Jul. 2012, the entire contents and substance of which are hereby incorporated by reference.

STATEMENT REGARDING FEDERALLY SPONSORED RESEARCH OR DEVELOPMENT

N/A

BACKGROUND OF THE INVENTION

1. Field of Invention

The present invention relates generally to closure assemblies and methods for the manufacturing of closure assemblies.

2. Background and Related Art

Closure assemblies are known with a plastic screw cap that is screwed onto a neck, e.g. of a plastic container or of a spout fitted on a collapsible pouch container. A tamper-evident ring is integrally formed as a part of the plastic screw cap.

A known closure assembly is disclosed in WO2012/044166. Other examples of closure assemblies having a tamper-evident functionality are for instance disclosed in WO2009/00342, EP 1 930 248, and US 2009/0223963.

To further improve closure assemblies, the present invention aims to provide improved closure assemblies and methods for the manufacturing of closure assemblies.

BRIEF SUMMARY OF THE INVENTION

Briefly described, in a preferred form, the present invention comprises a closure assembly comprising a rotational cap comprising a top wall and a downward depending skirt, the skirt having an interior side, an exterior side, and a lower edge remote from the top wall, and a tamper-evident ring that is integrally molded to the skirt, the tamper-evident ring being composed of at least two ring segments, each ring segment having a base portion and an indicator portion, and an article forming a tubular neck around a product passage in the article, the neck having an exterior side, a main axis and forming a mouth at a top end of the product passage, the exterior side of the neck and the interior side of the skirt have cooperating first and second screw threads on the neck and skirt respectively, wherein the rotational cap capable of being secured on the neck of the article, the cap sealing the product passage in a closed position of the cap on the neck, and the cap—for removal of the cap from the neck of the article by a user to open the product passage—being adapted to be manually rotated from the closed position in an opening direction, wherein the base portion is connected via one or more non-frangible connector portions to the skirt, the base portion extending from a trailing end thereof in the opening direction over a base portion angle about the main axis, the base portion having an inner face with an inner face radius about the main axis, wherein the indicator portion is integral with the base portion at a junction and extends from the junction in the opening direction over an indicator portion angle about the main axis to a head end of the indicator portion, wherein the indicator portion is connected at the head end thereof via a frangible bridge to an adjacent trailing end of a base portion of another ring segment, wherein the article has for each ring segment of the tamper-evident ring a rotation preventing boss, the boss being arranged to be engaged by a corresponding head end of an indicator portion of the segment, wherein upon rotating the cap in the opening direction by the user from its closed position for the first time, the head end of the indicator portion engages the boss, which then prevents the head end from further motion in the opening direction of the cap, the frangible bridge between the head end and the trailing end of the base portion breaking, and the indicator portion being subjected to permanent deformation, wherein the boss has a catch portion having a recess at a side of the boss facing the head end of the indicator portion and having an catch portion outer wall with an outer face that is arranged along the inner face of the base portion near the trailing end thereof when the cap is in its closed position, wherein the head end of the indicator portion is arranged at a spacing radially inward from the trailing end of the adjacent base portion when the cap is in its closed position, and wherein upon rotating the cap in the opening direction by the user from its closed position for the first time, the head end of the indicator portion enters the recess of the catch portion and is then prevented from further motion in the opening direction of the cap, while the catch portion outer wall comes in the spacing between the spaced apart head end and the trailing end, the frangible bridge between the head end and trailing end breaking and the indicator portion manipulated while being subjected to permanent deformation upon further rotation of the cap in the opening direction.

The manipulation of the indicator portion can be selected from the group consisting of bending, folding, and buckling.

In another preferred embodiment, the present invention comprises an article that is injection molded of plastic material and forms a tubular neck around a product passage in the article, the neck having a main axis and forming a mouth at a top end of the product passage, the neck having an exterior side;

a rotational cap that is injection molded of plastic material and capable of being secured on the neck of the article, the cap sealing the product passage in closed position of the cap on the neck, and the cap—for removal of the cap from the neck of the article by a user to open the product passage—being adapted to be manually rotated from the closed position in an opening direction;

wherein the cap comprises a top wall and a downward depending skirt, the skirt having an interior side, an exterior side, and a lower edge remote from the top wall;

wherein the exterior side of the neck and the interior side of the skirt have cooperating first and second screw threads on the neck and skirt respectively;

wherein the cap furthermore comprises a tamper-evident ring that is integrally molded to the skirt, the tamper-evident ring being composed of at least two ring segments, each ring segment having a base portion and an indicator portion;

wherein the base portion is connected via one or more non-frangible connector portions to the skirt, the base portion extending from a trailing end thereof in the opening direction over a base portion angle about the main axis, the base portion having an inner face with an inner face radius about the main axis;

wherein the indicator portion is integral with the base portion at a junction and extends from the junction in the opening direction over an indicator portion angle about the main axis to a head end of the indicator portion;

wherein the indicator portion is connected at the head end thereof via an integrally molded frangible bridge to an adjacent trailing end of a base portion of another ring segment;

wherein the article has for each ring segment of the tamper-evident ring a rotation preventing boss, the boss being arranged to be engaged by a corresponding head end of an indicator portion of the segment;

wherein the cap with tamper-evident ring is embodied such that upon rotating the cap in the opening direction by the user from its closed position for the first time, the head end of the indicator portion engages the boss which then prevents the head end from further motion in the opening direction of the cap, the frangible bridge between the head end and the trailing end of the base portion breaking, and the indicator portion being subjected to permanent deformation;

wherein the boss has a catch portion having a recess at a side of the boss facing the head end of the indicator portion and having an catch portion outer wall with an outer face that is arranged along the inner face of the base portion near the trailing end thereof when the cap is in its closed position;

wherein the head end of the indicator portion is arranged at a spacing radially inward from the trailing end of the adjacent base portion when the cap is in its closed position; and wherein upon rotating the cap in the opening direction by the user from its closed position for the first time—the head end of the indicator portion enters the recess of the catch portion and is then prevented from further motion in the opening direction of the cap, while the catch portion outer wall comes in the spacing between the spaced apart head end and the trailing end, the frangible bridge between the head end and trailing end breaking and the indicator portion being manipulated by one or more of bending, folding, and buckling while being subjected to permanent deformation upon further rotation of the cap in the opening direction.

The trailing end of the base portion can overlap the head end in circumferential direction when the cap is in its closed position.

The inner face of the base portion can lie against the outer face of the catch portion of the boss when the cap is in its closed position.

The catch portion can be in top view one of U or C-shaped with the catch portion having two legs, wherein one of the legs is formed by the catch portion outer wall and with the recess extending in circumferential direction between the two legs.

The indicator portion can buckle inwardly towards the neck of the article when the head end is prevented by the catch portion from further rotation with the cap in the opening direction, and the inwardly buckled indicator portion—upon continued rotation of the cap in the opening direction—forcibly passing along the outer face of the catch portion and thereby being folded to extent along the inner face of the base portion.

The lower edge of the skirt can be provided with downward projecting cap abutment portions each having an abutment face in circumferential direction of the cap, wherein the bosses are each embodied with an article abutment portion each having an abutment face in circumferential direction, so that upon screwing the cap onto the neck each cap abutment portion abuts with its abutment face in circumferential direction against the corresponding abutment face of an article abutment portion of the boss and thereby defines the closed position of the cap fully screwed onto the neck.

The article can have two bosses at diametrically opposed positions relative to the neck, and the cap can have two ring segments.

The article can be a fitment to be secured to a container body.

The article can be a spout, the spout having a lower connector portion adapted to be secured between opposed film walls of a collapsible pouch container.

The article can have at least a topmost flange on the neck, the one or more flanges each protruding outwardly and extending circumferentially around the neck, and wherein the bosses are raised from the topmost flange.

The cap can be provided with an annular outer gripping portion that extends generally concentrically about the skirt, the gripping portion being integral with the skirt via a spoke structure.

The frangible bridge can extend substantially in radial direction between the head end and the trailing end.

In another exemplary embodiment, from the head end towards the junction a major section of the indicator portion can be arranged at a smaller radius relative to the main axis than the inner face radius of the base portion, a junction section of the indicator portion extending between the major section and the base portion, wherein the indicator portion buckles inwardly towards the neck and upon continued rotation of the cap in the opening direction forcibly passing along the outer face of the catch portion and thereby being folded to extent substantially along the inner face of the base portion.

The abutment portion of the boss can lie between the catch portion of the boss and the neck of the article.

Each cap abutment portion can extend as a semi-circular portion about the main axis and has a lower end face slanting upwards from the lower end of the abutment face.

The article can be a spout having a lower connector portion with two fins extending in opposed directions, wherein the spout has a neck, wherein the neck is provided with two bosses at diametrically opposed positions relative to the neck, and wherein the two bosses lie in a plane extending through the two fins, and wherein the cap has two ring segments.

The topmost flange can extend underneath at least the head end of the indicator portion when the cap is in its closed position.

The abutment portion can be embodied as a radial rib, wherein the catch portion is embodied as one of a C or U-shaped part with one leg of the part generally transverse to the rib and one leg of the part forming the catch portion outer wall with the recess between the legs.

In another exemplary embodiment, the present invention can be a collapsible pouch container provided with a closure assembly comprising a collapsible pouch container comprising a container body having opposed film walls, and a closure assembly comprising a spout that is injection molded of plastic material and a rotational cap that is injection molded of plastic material;

wherein the spout has a lower connector portion that is secured between the opposed film walls, and wherein the spout has a tubular neck around a product passage in the spout, the neck having a main axis and forming a mouth at a top end of the product passage, the neck having an exterior side;

wherein the cap is secured on the neck of the spout, the cap sealing the product passage in closed position of the cap on the neck, and wherein the cap—for removal of the cap from the neck of the article by a user to open the product passage—is adapted to be manually rotated from the closed position in an opening direction;

wherein the cap comprises a top wall and a downward depending skirt, the skirt having an interior side, an exterior side, and a lower edge remote from the top wall;

wherein the exterior side of the neck and the interior side of the skirt have cooperating first and second screw threads on the neck and skirt respectively;

wherein the cap furthermore comprises a tamper-evident ring that is integrally molded to the skirt, the tamper-evident ring being composed of at least two ring segments, each ring segment having a base portion and an indicator portion;

wherein the base portion is connected via one or more non-frangible connector portions to the skirt, the base portion extending from a trailing end thereof in the opening direction over a base portion angle about the main axis, the base portion having an inner face with an inner face radius about the main axis;

wherein the indicator portion is integral with the base portion at a junction and extends from the junction in the opening direction over an indicator portion angle about the main axis to a head end of the indicator portion;

wherein the indicator portion is connected at the head end thereof via an integrally molded frangible bridge to an adjacent trailing end of a base portion of another ring segment;

wherein the spout has for each ring segment of the tamper-evident ring a rotation preventing boss, the boss being arranged to be engaged by a corresponding head end of an indicator portion of the segment;

wherein the cap with tamper-evident ring is embodied such that upon rotating the cap in the opening direction by the user from its closed position for the first time, the head end of the indicator portion engages the boss which then prevents the head end from further motion in the opening direction of the cap, the frangible bridge between the head end and the trailing end of the base portion breaking, and the indicator portion being subjected to permanent deformation;

wherein the boss has a catch portion having a recess at a side of the boss facing the head end of the indicator portion and having an catch portion outer wall with an outer face that is arranged along the inner face of the base portion near the trailing end thereof when the cap is in its closed position;

wherein the head end of the indicator portion is arranged at a spacing radially inward from the trailing end of the adjacent base portion when the cap is in its closed position; and wherein upon rotating the cap in the opening direction by the user from its closed position for the first time—the head end of the indicator portion enters the recess of the catch portion and is then prevented from further motion in the opening direction of the cap, while the catch portion outer wall comes in the spacing between the spaced apart head end and trailing end, the frangible bridge between the head end and trailing end breaking and the indicator portion being manipulated by one or more of bending, folding, and buckling while being subjected to permanent deformation upon further rotation of the cap in the opening direction.

In the present inventive closure assembly the boss has a catch portion having a recess at a side of the boss facing the head end of the indicator portion and having an catch portion outer wall with an outer face that is arranged along the inner face of the base portion near the trailing end thereof when said cap is in its closed position.

The head end of the indicator portion is arranged at a spacing radially inward from the trailing end of the adjacent base portion when said cap is in its closed position, preferably the trailing end overlapping the head end in circumferential direction.

The inventive design is such that—upon rotating the cap in opening direction by the user from its closed position for the first time—the head end of the indicator portion enters the recess of the catch portion and is then prevented from further motion in opening direction of the cap, whilst the catch portion outer wall comes in the spacing between the spaced apart head end and trailing end, the frangible bridge between said head end and trailing end breaking and the indicator portion bending, folding, and/or buckling whilst being subjected to permanent deformation upon further rotation of the cap in opening direction.

Compared to the mentioned WO2012/044166 assembly the presence of the boss is basically obscured by the overlapping trailing end of the base portion of the segment, whereas in said prior art the boss is well visible in side view onto the assembly. The invention allows embodying the ring segments such that initially they appear to the user as a single continuous band in side view. This is not only aesthetically pleasing but also facilitates the user in determining whether the closure has been opened once the indicator portions have been deformed in the process and the continuity of the band is broken.

Also the invention allows for a very effective deformation of the indicator portions, as the head end thereof is caught in the recess and significant deformation must occur before the head end is able to leave the recess. This enhances the finally obtained deformation of the indicator portion and may contribute to an audible effect upon opening the cap for the first time.

In an advantageous embodiment the trailing end of the base portion overlaps the head end in circumferential direction when said cap is in its closed position, preferably with the frangible bridge extending substantially in radial direction between the head end and the trailing end. The latter radial arrangement allows a quick and easy breakage of the bridge compared to one extending in circumferential direction. Also the frangible bridge is now hidden behind the trailing end of the base portion, which is aesthetically pleasing and also avoids premature destruction of the bridge, e.g. during storage and transport or during handling of the cap, e.g. when being screwed onto the neck of the article.

In an embodiment only a single frangible bridge is present between the head end and the base portion, as is preferred. In an advantageous embodiment said single bridge is arranged between the top (in vertical direction) of the head end and the top of the base portion, which e.g. facilitates injection molding the cap.

In order to assure the correct position of the trailing end of the base portion, and thereby of the interconnected head end relative to the recess in the catch portion, it is preferred for the inner face of the base portion to be positioned against the outer face of the boss when the cap is in its closed position.

In a preferred embodiment the catch portion is—when seen in top view—U or C-shaped with one leg thereof being formed by the catch portion outer wall and with the recess extending in circumferential direction between said one leg and the other leg, for example the recess having a depth in circumferential direction of at least 1.5 millimeters.

In an advantageous embodiment the indicator portion is embodied to buckle inwardly towards the neck of the article when the head end is prevented by the catch portion from further rotation with the cap in opening direction, and said inwardly buckled indicator portion—upon continued rotation of the cap in opening direction—being forced to pass along its outer face thereby being folded to extent along the inner face of the base portion.

In this design—upon rotating the cap in opening direction by the user from its closed position for the first time—the indicator portion buckles inwardly towards the neck and upon continued rotation of the cap in opening direction eventually folds over against or substantially along the inner face of the base portion. This folding or doubling over preferably takes place so that the junction shows an inward fold. It will be appreciated that in the process the head end is able to become free from the catch portion but the deformation by buckling that has already been caused is such that the inwardly deformed indicator portion will then be forced to pass the boss and deform further so that eventually the indicator portion becomes folded against or along the inner face of the base portion.

In an embodiment that is designed to exhibit the above inward buckling functionality the indicator portion has a major section that extends from its head end towards the junction with the base portion, for example this major section of the indicator portion having at least 50% of the entire circumferential length of the indicator portion. It is envisaged that this major portion is arranged at a smaller radius relative to the main axis than the inner face radius of the base portion. A junction section of the indicator portion then extends between this major section and the base portion. For example the junction section is curved, e.g. as a stretched S or as an about 90° arc, between the base portion and the major portion, but other junction section embodiments, e.g. embodied as a hinge with a local thinned area, are also possible.

In a design the junction section exhibits the initial inward buckling when the head end is stopped by the catch portion.

In another design the indicator portion has a major portion that extends on the same radius as the base portion, with only the head end being arranged or embodied to extend inward from the base portion radius. Such a design can be embodied to bend or buckle outwards upon opening the cap for the first time. For example the indicator portion bends to form an outward arc with the center moving away significantly from the skirt of the cap before the head end is able to snap free from the catch portion.

If desired the indicator portion can be provided with one or more hinges, e.g. embodied as a thinned area of the portion. For example the junction section is embodied as a hinge and/or a hinge is present at a central location between the junction section and the head end, the one or more hinges facilitating the local folding of the indicator portion.

In an embodiment the lower edge of the skirt is provided with downward projecting cap abutment portions having an abutment face in circumferential direction of the cap, and the bosses are each embodied with an article abutment portion having an abutment face in circumferential direction, so that upon screwing the cap onto the neck each cap abutment portion abuts with its abutment face in circumferential direction against the corresponding abutment face of an article abutment portion of the boss and thereby defines the closed position of the cap fully screwed onto the neck.

In this design the bosses perform both the task of cooperating with the head end of the indicator part and cooperating with the cap abutment portion. This integration of functions allows for a compact design whilst providing sufficient stability for the boss to ensure these tasks.

In this regard it is noted that screw caps are usually screwed onto the neck using automated capping equipment with a torque controlled cap screwing device. In order to ensure that the cap is always correctly on the neck one desires to screw the cap on the neck with a substantial torque. As the boss performs two functions, the plastic volume can be used diligently to obtain a stable design of the boss thereby allowing for such substantial torque.

Also this design allows to achieve the effect that, with the cap screwed against the boss as limit stop, the head end of the indicator portion lies closes in front of the recess, e.g. within at most 4 millimeters, so that very soon after starting to open the cap the head end comes into engagement with the catch portion and is stopped from further motion in opening direction.

In an embodiment the abutment portion of the boss lies between the catch portion of the boss and the neck of the article. In a practical embodiment the article abutment portion is embodied as a radial rib and the catch portion as a C or U-shaped part—in top view—with one leg thereof at right angles to the outward end of the rib and one leg forming the catch portion outer wall with the recess there between. The T-shaped structure of the rib with the one leg at its outward end provides significant stability with little use of plastic material.

In an embodiment each cap abutment portion extends as a semi-circular portion about the main axis and has a lower end face slanting upwards from the lower end of the abutment face. This allows for a sturdy design of the cap abutment portion whilst ensuring that the lower end face passes over the bosses of the article during screwing the cap onto and from the neck.

In a preferred embodiment the article has two bosses at diametrically opposed positions relative to the neck, and the cap has two ring segments. This is e.g. advantageous for assemblies with an inner diameter of the passageway in the range between 6 and 12 millimeters.

It will be appreciated that preferably the catch portion with the recess therein is located at a radial distance from the neck of the article, in particular in an embodiment wherein the indicator portion is designed to buckle inwardly and/or in an embodiment wherein the article abutment portion lies between the catch portion and the neck of the article.

It is envisaged in particular that the article is a fitment to be secured to a container body, e.g. the article is a spout, e.g. having a lower connector portion to be secured between opposed film walls of a collapsible pouch container or embodied as an annular flange to be secured around on opening in a container, e.g. a pouch container or a carton, etc.

In an embodiment the article is a spout having a lower connector portion to be secured between opposed film walls of a collapsible pouch container with two fins extending in opposed directions, wherein the article has two bosses that lie in a vertical plane through these fins.

In an embodiment the article has at least a topmost flange on the neck, the one or more flanges each protrude outwardly and extending circumferentially around the neck, wherein the bosses are raised from the topmost flange, preferably also integral directly with the neck to enhance stability, e.g. embodied with an abutment portion as described herein. In an embodiment hereof the topmost flange extends underneath at least the head end of the indicator portion when said cap is in its closed position. In this manner the flange prevents the head end from moving downward when it attempts to clear the recess of the catch portion.

In an embodiment the indicator portion has a major section that extends from its head end towards the junction with the base portion, for example this major section of the indicator portion having at least 50% of the entire circumferential length of the indicator portion. It is envisaged that this major portion is arranged at a smaller radius relative to the main axis than the inner face radius of the base portion. A junction section of the indicator portion then extends between this major section and the base portion. The article further has a topmost flange that extends underneath the major section of the indicator portion when said cap is in its closed position, e.g. providing guidance for the underside of the indicator portion when buckling or folding inward towards the neck.

In an embodiment with two ring segments and two bosses, an embodiment envisages that the base portion of each ring segment extends over at least 90° about the main axis. This provides a very stable structure of the base portion and in a version with an inward folding indicator portion it is ensured that the indicator portion when completely folded is outwardly obscured from side view by the longer base portion.

In an embodiment the base portion is connected to the skirt via a horizontal wall portion extending between a top of the base portion and the skirt at a height above the lower end thereof. For example the horizontal wall portion is embodied as a segment of an annulus, possibly with one or more axial holes therein, e.g. in view of saving of plastic material or in view of the injection mould design.

In an embodiment one can envisage that one or more additional breakable bridges are present between the indicator portion and the skirt of the cap.

In a practical embodiment the user does not grip the exterior side of the skirt directly but the cap is provided with an annular outer gripping portion that extends concentrically about the skirt, preferably the gripping portion being integral with the skirt via a spoke structure, e.g. including multiple radial spoke portions, the cap being embodied preferably so as to leave air passages between the gripping portion and the skirt.

The present invention also relates to a container provided with a closure assembly according to the invention, e.g. a collapsible pouch container.

The present invention also relates to a method of opening a closure assembly according to the invention.

The present invention also relates to a method of manufacturing and filling of a container comprising the steps of:

providing a container having the article, filling the container via the product passage in the article, screwing the cap onto the neck of the article, e.g. using an automated cap screw device.

These and other objects, features and advantages of the present invention will become more apparent upon reading the following specification in conjunction with the accompanying drawing figures.

BRIEF DESCRIPTION OF THE DRAWINGS

Various features and advantages of the present invention may be more readily understood with reference to the following detailed description taken in conjunction with the accompanying drawings, wherein like reference numerals designate like structural elements, and in which.

DETAILED DESCRIPTION OF THE INVENTION

Figure 1:
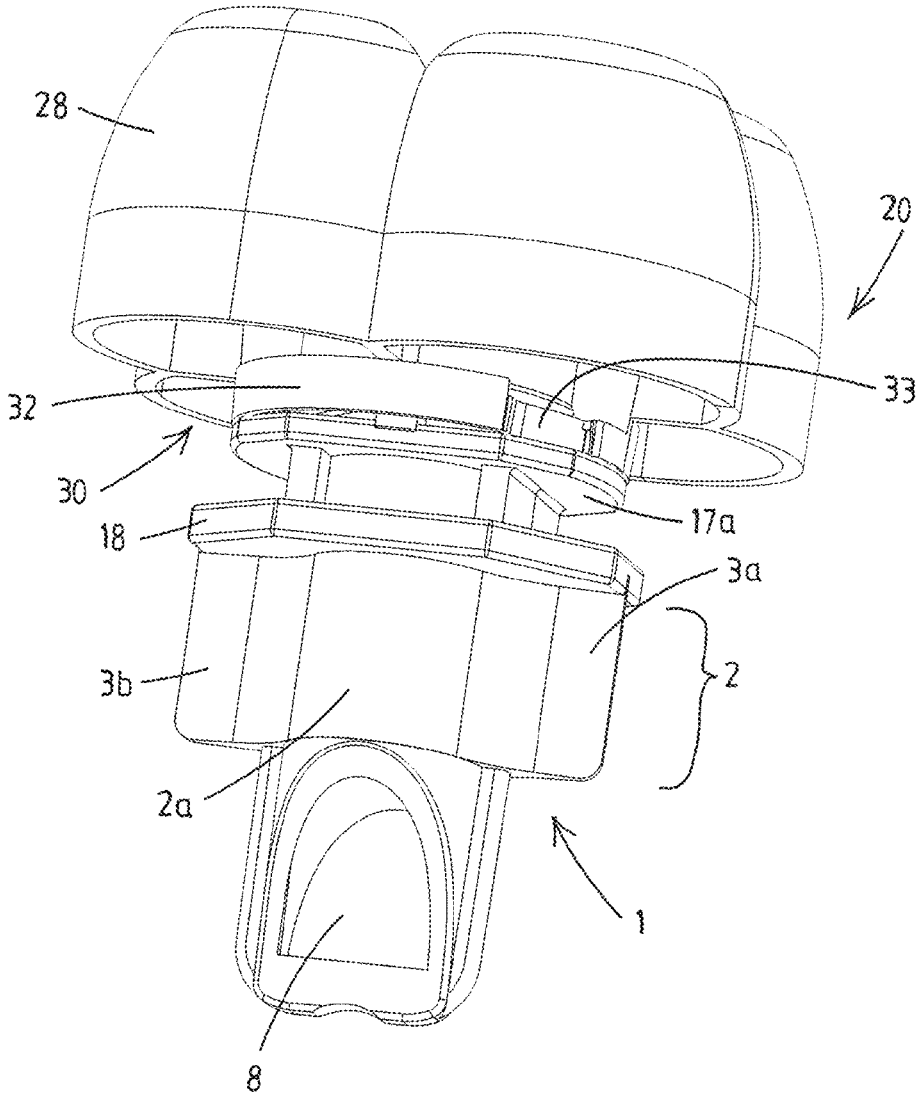
FIG. 1 shows a closure assembly according to the invention in perspective view, FIG. 2 the assembly of FIG. 1 from above, FIG. 3 the assembly of FIG. 1 in vertical cross-section, FIG. 4 the spout of the assembly of FIG. 1 in perspective view, FIG. 5 the spout of FIG. 4 from above, FIG. 6 the spout of FIG. 4 in side view, FIG. 7 the cap of the assembly of FIG. 1 in perspective view from above, FIG. 8 the cap of the assembly of FIG. 1 in perspective view from below, FIG. 9 a lower portion of the cap of FIG. 7, FIG. 10 the assembly of FIG. 1 horizontally cut above the tamper-evident ring, FIG. 11 the view of FIG. 10 from above, FIGS. 12 *a-d* a portion of the assembly in a view as FIG. 11 in different stages during the opening of the cap for the first time, and FIG. 13 an alternative embodiment of the indicator portion of the assembly according to the invention.
Figure 2:
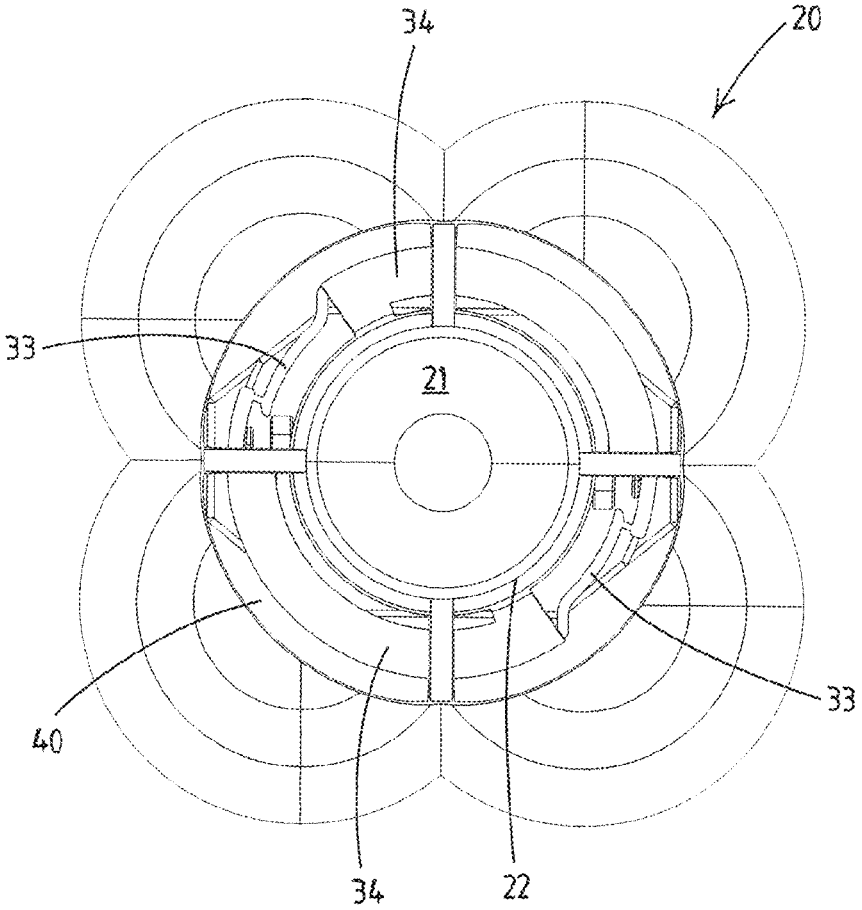
Figure 3:
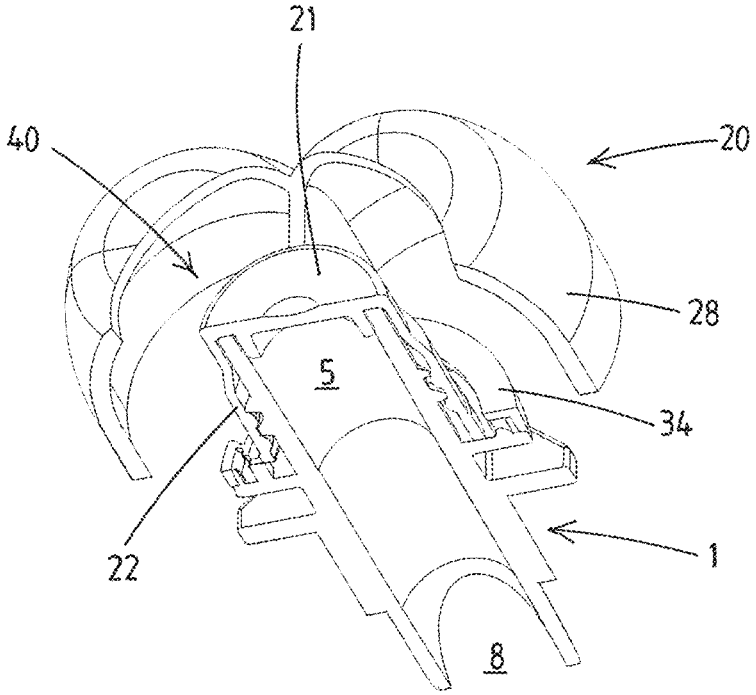
Figure 4:
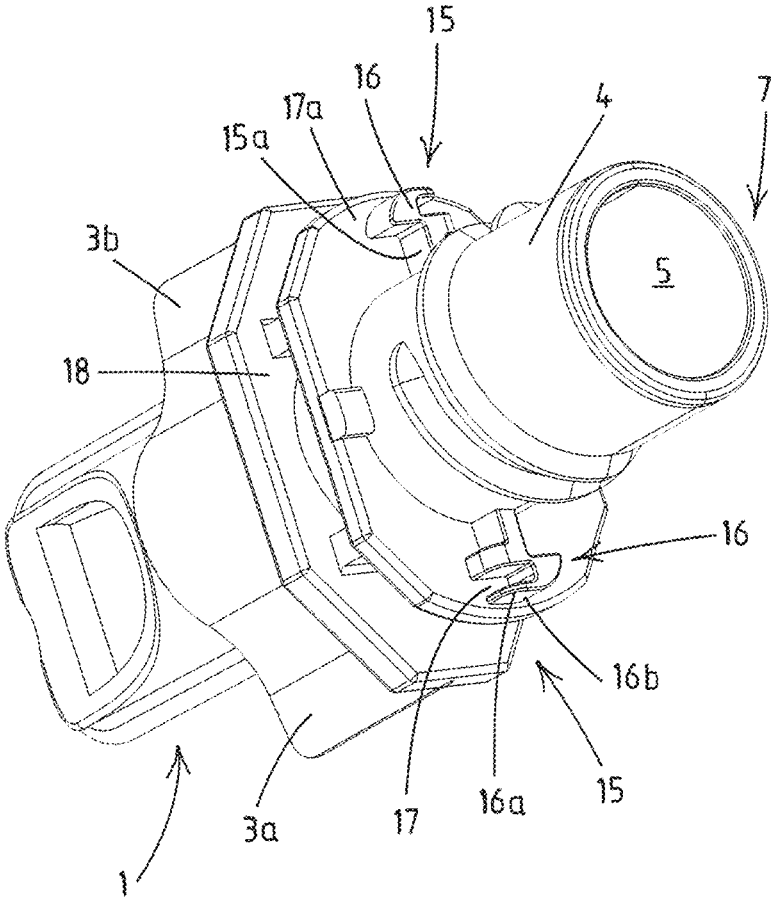
Figure 5:
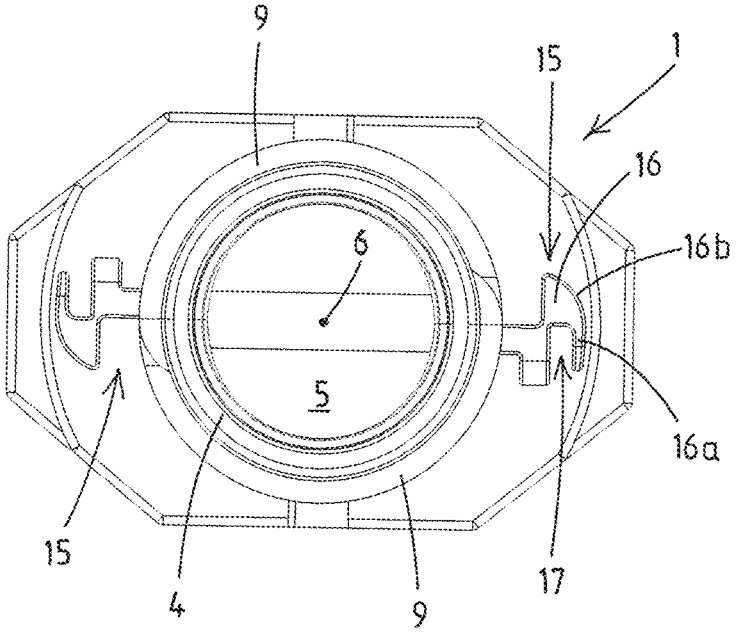
Figure 6:
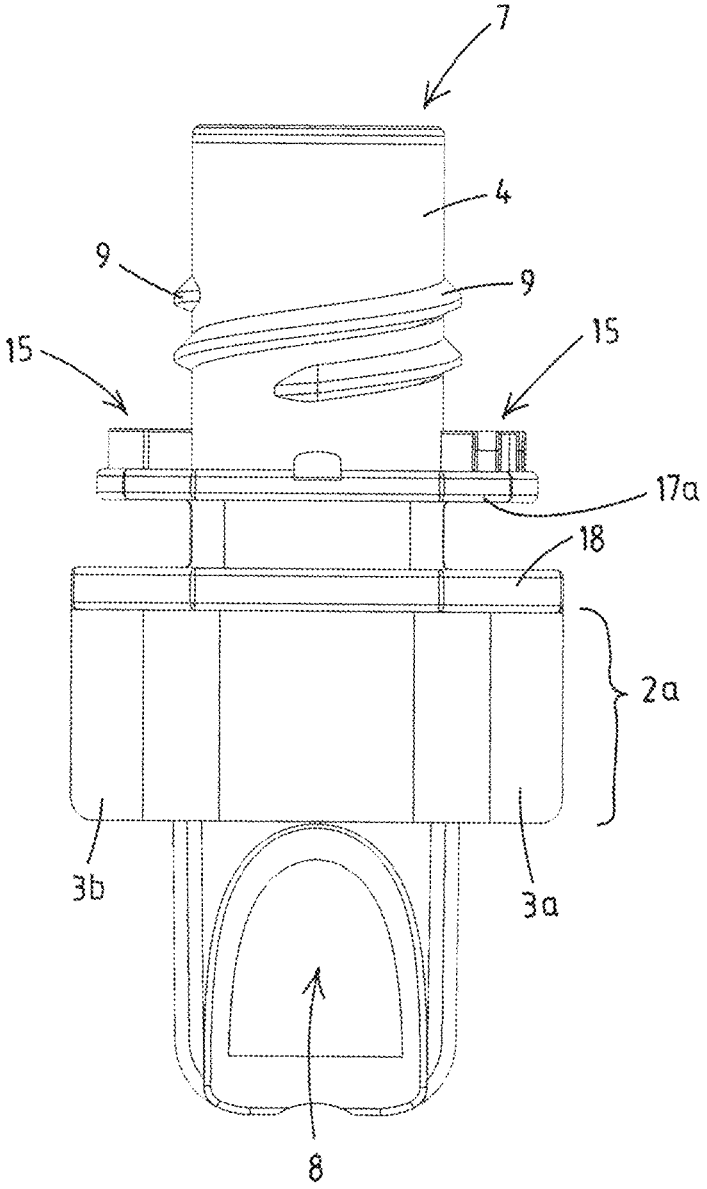
Figure 7:
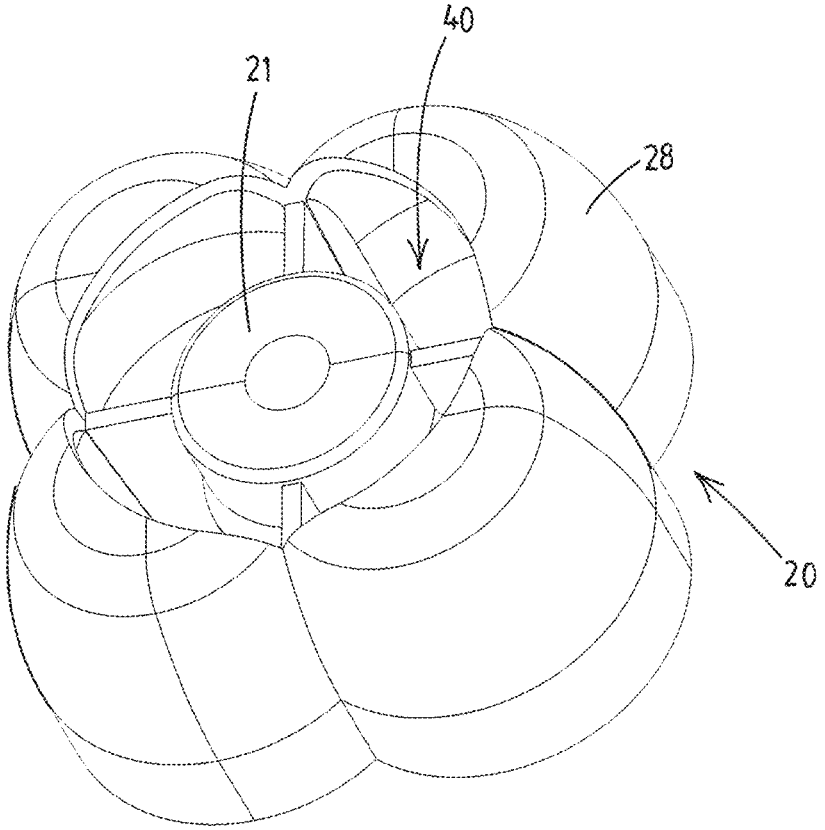

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or illustrated in the drawings. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

With reference to FIGS. 1-12 now a first embodiment of a closure assembly according to the invention will be discussed.

The assembly generally comprises two plastic components, namely an article 1 (here embodied as a spout) and a cap 20. In some figures the components are shown as assembled, in other figures each component is shown separately.

In a preferred embodiment, the article 1 is embodied as a spout that is injection molded as a unitary product in a mould.

The spout 1 is adapted to be secured with a lower connector portion 2 thereof between opposed film walls of a collapsible pouch container. The lower connector portion 2, as is preferred, here includes two fins 3*a, b* that extend in opposite directions from a central tubular part 2*a* of the lower portion 2. These fins 3*a, b* lie in a common imaginary vertical plane. The central portion 2*a* here is essentially circular in horizontal cross-section but other shapes, e.g. oval, elliptical, etc, are also possible.

The lower connector portion 2 is preferably heat sealed between opposed film walls of a pouch container. Such techniques are known in the art.

The spout 1 forms, here above the lower connector portion 2, a tubular neck 4 around a product passage 5 in the spout. The neck 4 has a main axis 6 and forms a mouth 7 at the top end of the product passage 5. As is known, the passage 5 extends through the lower connector portion to one or more lower openings 8. The figures relate to a design wherein the passage 5 has a diameter of about 8 millimeters.

The neck has an exterior side that is provided with screw thread formations 9, here a double screw thread formations as is preferred to provide two 180° angularly offset starting positions for the cap 20.

The cap 20 is injection molded of plastic material as a unitary product.

The cap 20 is adapted to be secured on the neck 4, which can be done in an assembly line to manufacture pre-assembled assemblies as shown in FIG. 1. The cap 20 can also be delivered separately from the spout 1 to e.g. a company producing filled pouches. For example the spout 1 is sealed into a pouch, the pouch is filled via the passage 5 and then the cap 20 is placed on the neck 4 by an automated cap screwing device.

The cap 20 seals the product passage 5 in closed position of the cap on the neck as shown in FIG. 1. For removal of the cap 20 from the neck 4 by a user to open the product passage 5 the user manually rotates the cap from the closed position in an opening direction, here counter clockwise as is preferred.

The cap 20 comprises a top wall 21 and a downward depending annular skirt 22. The skirt has an interior side, an exterior side, and a lower edge remote from the top wall 21.

The interior side of the skirt is provided with screw thread formations 23 that cooperate with the screw thread formations 11 on the neck 4.

The cap 20 comprises a tamper-evident ring 30 that is integrally molded to the skirt 22.

The tamper-evident ring 30 is composed here of two ring segments 31. Each ring segment has a base portion 32 and an indicator portion 33.

The base portion 32 is connected via one or more non-frangible connector portions 34 to the skirt 22.

The base portion 32 extends from a trailing end 32*a* thereof in opening direction over a base portion angle about the main axis 6. The base portion has an inner face 32*b* with an inner face radius about the main axis 6.

The indicator portion 33 is integral with the base portion 32 at a junction 33*a* and extends from the junction 33*a* in opening direction over an indicator portion angle about the main axis 6 to a head end 35 of the indicator portion 33.

The indicator portion 33 is connected at the head end 35 thereof via an integrally molded frangible bridge 36 to an adjacent trailing end 32*a* of a base portion 32 of the other ring segment 31.

The spout 1 has for each ring segment 31 of the tamper-evident ring a rotation preventing boss 15. This boss 15 is engageable with a corresponding head end 35 of an indicator portion 33 of the segment 31. The spout 1 has two bosses 15 at diametrically opposed positions relative to the neck 4.

The boss 15 has a catch portion 16 having a recess 17 at a side of the boss facing the head end 35 of the indicator portion 33 and has an catch portion outer wall 16*a* with an outer face 16*b* that is arranged along the inner face of the base portion 32 near the trailing end 32*a* thereof when the cap 20 is in its closed position. This can be seen e.g. in FIG. 10.

The head end 35 of the indicator portion 33 is arranged at a spacing radially inward from the trailing end 32*a* of the adjacent base portion 32 when the cap 20 is in its closed position.

As is preferred to provide the image of a continuous ring when looking from the side to the assembly, the trailing end 32*a* of the base portion 32 overlaps the neighboring head end 35 in circumferential direction.

The general cooperation of the tamper-evident ring with the bosses 15 is such that—upon rotating the cap 20 in opening direction by the user from its closed position for the first time—the head end 35 of the indicator portion 33 enters the recess 17 of the catch portion 16 (see FIG. 12*a*) and is then prevented from further rotation of the cap in opening direction. The catch portion outer wall 16*a* comes in the spacing between the spaced apart head end 35 and trailing end 32*a* of the base portion. The frangible bridge 36 between the head end 35 and the trailing end 32*a* breaks. Upon further rotation of the cap in opening direction the indicator portion bends, folds, and/or buckles whilst being subjected to permanent deformation (see FIGS. 12*a-d*).

In FIGS. 1-12 it is illustrated that the invention envisages an embodiment wherein the indicator portion 33 is embodied to buckle inwardly towards the neck 4 when the head end 35 is prevented by the catch portion 16 from further rotation with the cap 20 in opening direction. In particular from FIGS. 12*a-d* it can be understood that once this buckling has taken place, continued rotation of the cap in opening direction, causes the inwardly buckled indicator portion to be forced to pass along the outer face of the catch portion and thus to collide with the catch portion. This forced passage along the catch portion 16 causes yet further deformation of the indicator portion such that eventually the indicator portion is folded into a shape that it extends along the inner face of the base portion 32. Of course due to some residual elasticity or otherwise the final result may not be that the indicator portion 33 lies neatly against the inner face, but at least extends along the inner face 32*b*.

As is preferred a cap abutment portion 25 is present, most preferably as a semi-circular portion that is spaced radially inwardly from the inner face 32*b*, such that in its final position the indicator portion 33 is retained in the space between said portion 25 and the inner face 32*b* of the base portion. This avoids or hinders any further access to the indicator portion 33, e.g. avoiding or countering that the portion 33 is pulled loose from the cap. It also avoids any interference of the fully deformed indicator portion with the operation of the screw thread of the cap.

In order to reliably achieve this inward buckling of the indicator portion, a preferred embodiment envisages that a major section 33*b* of the indicator portion 33 extending from the head end 35 towards the junction 33*a*, is arranged at a smaller radius relative to the main axis 6 than the inner face radius of the inner face 32*b* of the base portion 32.

As is preferred this major section has a length of at least 50% of the circumferential length of the indicator portion.

In addition to the major section the indicator portion has a junction section 33*c* that extends between the major section 33*b* and the base portion 32. This junction section 33*c* thus bridges the difference in diameter between the base section and the major section of the indicator portion, and is preferably curved, e.g. like a stretched S-shape as shown here.

The inward deformation of the indicator portion is due to the buckling load thereon once the catch portion of the boss 15 prevents further motion of the head end 35 in combination with the physical design of the indicator portion 33, the catch portion 16, and the junction to the base portion 32. If desired one or more thinned regions can be provided in the portion 33 and/or at the junction to enhance the inward buckling of the portion 33, e.g. with a thinned region halfway of the major section so that said region acts as a clear hinge.

The end result as far as the indicator portions 33 are concerned is that they are now effectively removed from their original position all together and, especially in side view on the assembly, are effectively hidden behind the base portions 32. They also do not stick out as they are hidden behind the base portions, which may also be seen as advantageous. Also in a top view onto the cap 20 the indicator portions 33, which were visible at the start of the opening of the cap, will have disappeared from their original position. In fact they are now hidden underneath the connector portions 34.

Figure 8:
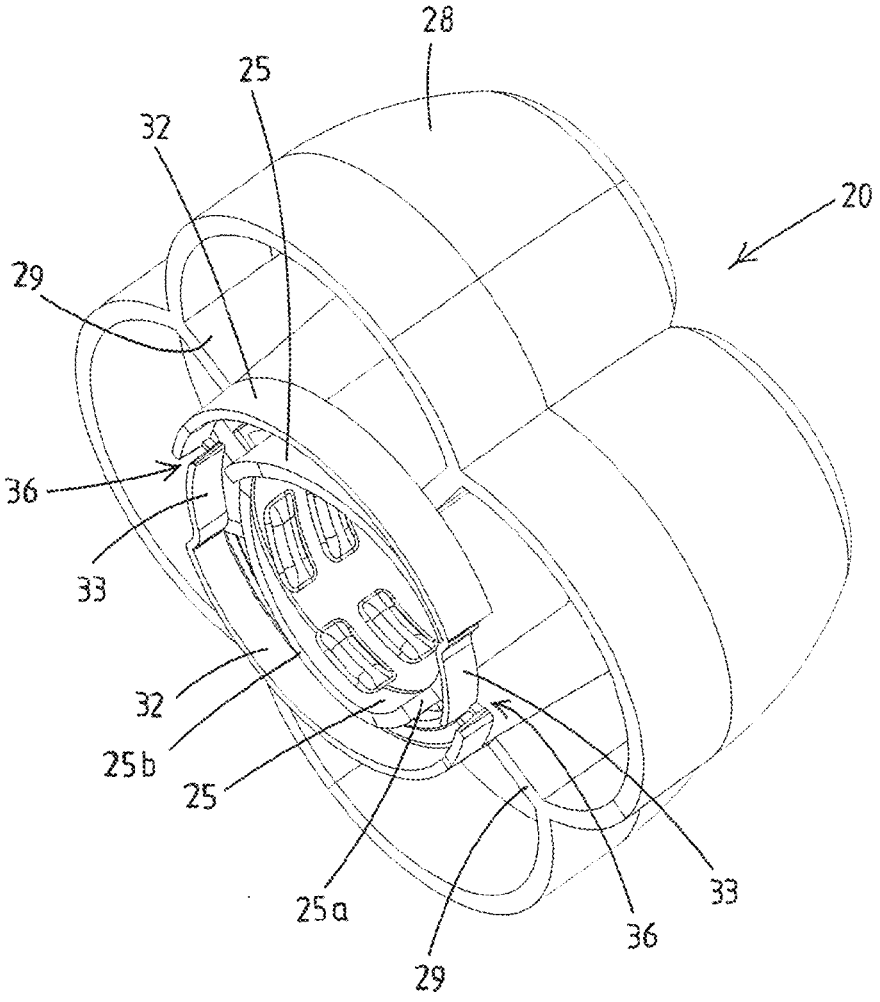
Figure 9:
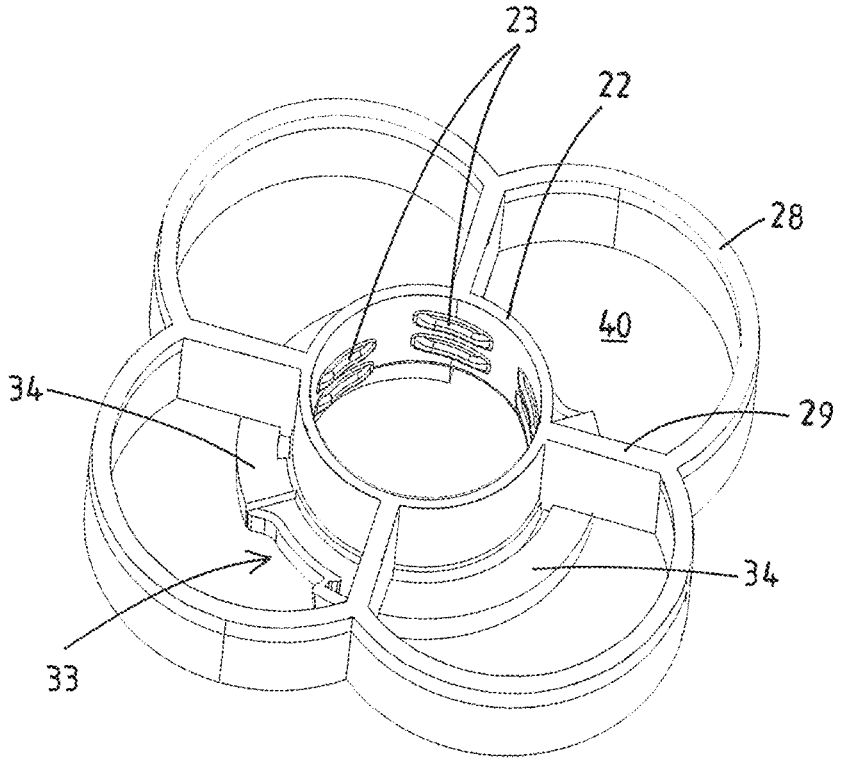
Figure 10:
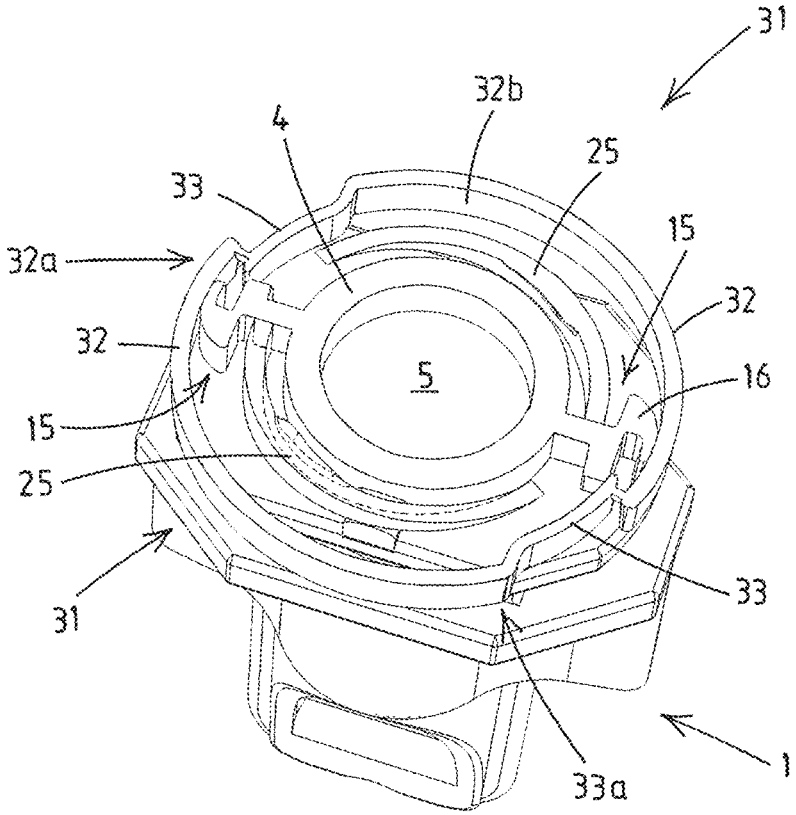
Figure 11:
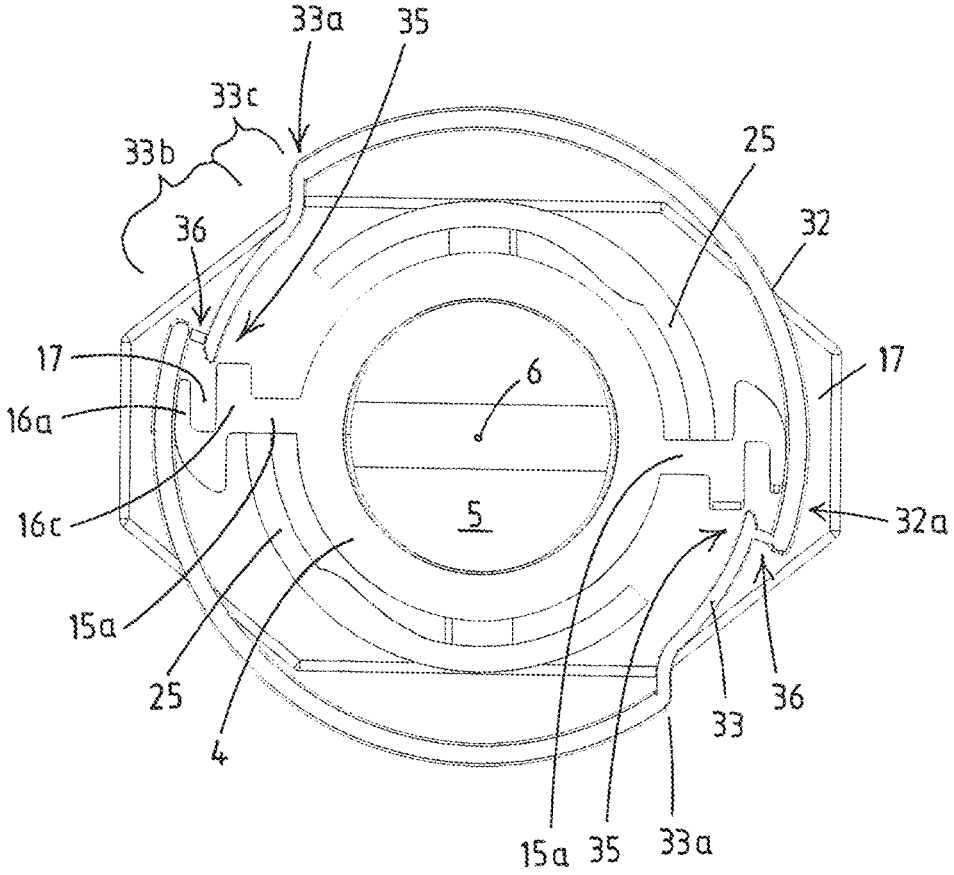
Figure 12A:
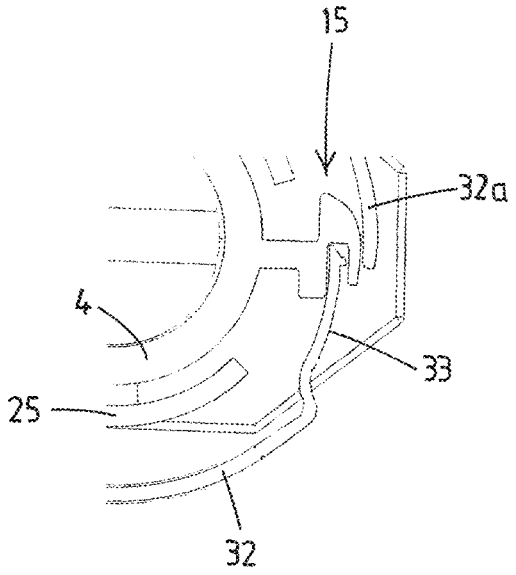
Figure 12B:
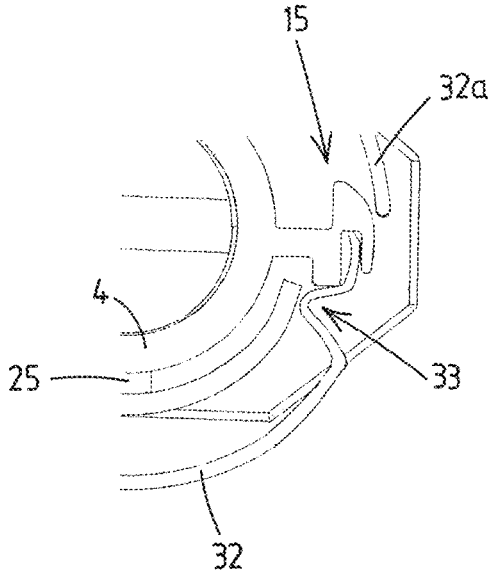
Figure 12C:
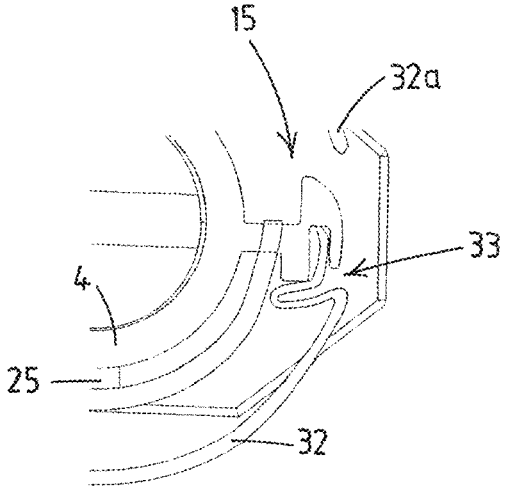
Figure 12D:
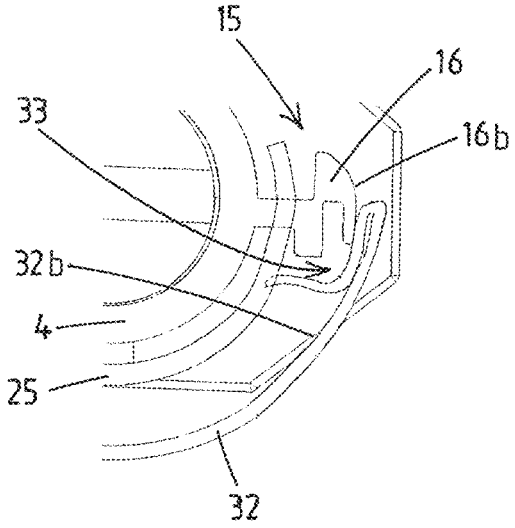

As can be seen in FIG. 8 the lower edge of the skirt 22 is provided with two downward projecting cap abutment portions 25 having an abutment face 25*a* in circumferential direction of the cap 20.

The bosses 15 are each embodied with an article abutment portion 15*a* having an abutment face 15*b* in circumferential direction, so that upon screwing the cap 20 onto the neck 4 each cap abutment portion 25 abuts with its abutment face in circumferential direction against the corresponding abutment face of an abutment portion 15*a* of the boss 15 and thereby defines the closed position of the cap fully screwed onto the neck 4.

As can be seen, the abutment portion 15*a* of the boss 15 lies between the catch portion 16 of the boss and the neck 4 and is, as preferred, embodied as a radial rib.

The catch portion 16 is embodied as a C- or U-shaped part in top view with one leg 16*c* at right angles to the rib 15*a* and one leg 16*a* forming the catch portion outer wall with the recess 17 there between.

The cap abutment portions 25 each extend as a semi-circular portion about the main axis 6 and each have a lower end face 25*b* that slants upwards in opening direction from the lower end of the abutment face. This allows the portions 25 to have sufficient strength yet pass above the bosses 15 when opening and closing the assembly.

The design of the abutment portions 25, 15*a* to act in circumferential direction is considered advantageous over a design wherein the final position of the cap 20 is determined by axially cooperation abutment faces as the accuracy of the final position is greater.

One other advantage of the double task design of the bosses 15 is that it can rather easily be ensured that the head ends 35 are properly aligned with the recesses 17, and also to have this aligned position with a short angular distance between the boss 15 and the neighboring head end 33. The latter allows the invention to achieve the effect that the user experiences an immediate operation of the tamper-evident ring as soon as the cap is rotated in opening direction.

The FIGS. also show that the spout 1 has two flanges, namely a topmost flange 17*a* and a lower flange 18 just above the connector portion 2*a*. The topmost flange 17*a* is located at a distance above the flange 18.

The flanges 17*a*, 18 each protrude outwardly from the neck and extend circumferentially around the neck. In an embodiment each flange 17*a*, 18 could be embodied with two flange parts, each directed away from the neck in opposite directions.

The bosses 15 are raised from the topmost flange 17*a*, are integral therewith at their lower end and are at the inner side also integral directly with the neck 4.

The figures show that the topmost flange 17*a* extends underneath at least the head end 35 of the indicator portion when the cap is in its closed position. As is preferred, the topmost flange extends underneath the major section 33*b* of the indicator portion when the cap is in its closed position.

In the embodiment depicted here the base portion 32 of each ring segment 31 extends over at least 90° about the main axis 6. In other designs the base portion can be significantly shorter in circumferential direction, but the large length is preferred in combination with the indicator portion 33 that doubles over along the inside of the base portion. Then this folded indicator portion is effectively hidden or retained behind the longer base portion 32.

As can be seen the base portion 32 is connected to the skirt 22 via a horizontal wall portion 34 extending between a top of the base portion 32 and the skirt 22 at a height above the lower end thereof.

If desired one or more additional breakable bridges could be present between the indicator portion 33 and the skirt 22 of the cap.

The cap 20 is provided with an annular outer gripping portion 28 that extends concentrically about the skirt 22. The gripping portion 28 is integral with the skirt 22 via a spoke structure including multiple radial spoke portions 29. As shown here, the cap 20 is embodied so as to leave air passages between the gripping portion and the skirt.

It is preferred, and illustrated here, that the indicator portions 33 in their initial position are visible from the top end of the cap when looking through said air passages 40. This allows the user to see whether the indicator portions 33 are still in their initial portion or not, which indicates whether or not the cap has been opened earlier.

Figure 13:
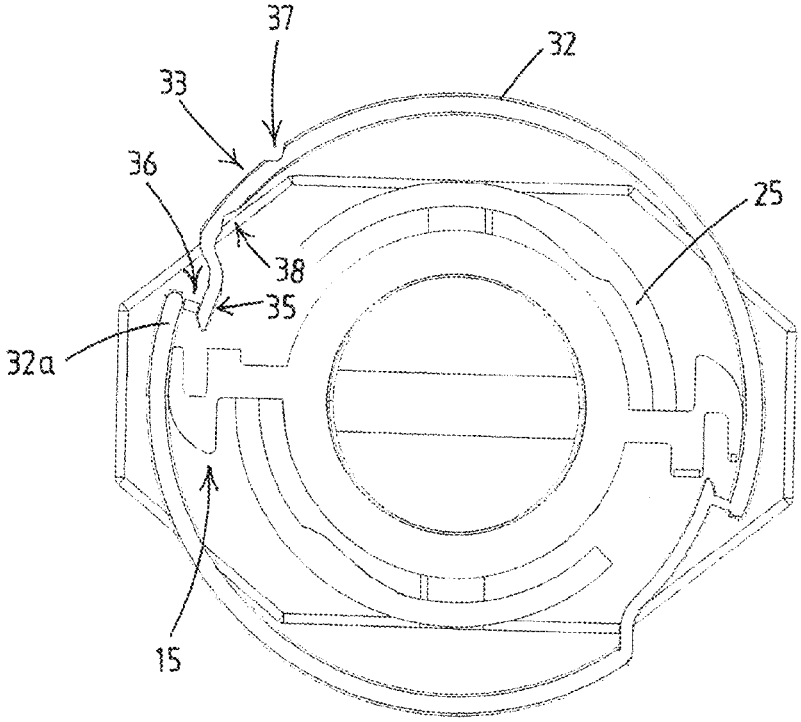

In the upper left hand corner of the assembly of FIG. 13 an alternative embodiment of the indicator portion 33 of the assembly according to the invention is shown. Here it is envisaged that once the head end 35 is stopped by the catch portion 16, the indicator portion 33 will fold in outward direction instead of inward as discussed above with reference to FIGS. 1-12. As one can see, in this embodiment the junction forms a continuation of the semi-circular shape of the base member and the major section also continues in semi-circular shape. On at the head end 35 the indicator portion has a bend inwards so that the head end is aligned with the recess 17 in the catch portion 16.

To enhance the desired folding of the indicator portion 33 thinned regions 37, 38 are shown here; one at the junction with the base portion 32 and one halfway the major section of the indicator portion.

One can also envisage a design wherein the base portion 32 is much shorter than depicted here, and wherein the indicator portion is much longer, e.g. extending over more than 90° about the main axis, with the base portion being shorter in circumferential direction than the indicator portion. This is for example envisaged in a two segments—two bosses' version of the assembly, wherein the indicator portions bend in the opening process of the cap outwardly into the form of an arch until the stresses on the head end are such that said head end comes free of the recess in the catch portion. In a suitable design the deformation of the indicator portions will be such that permanent deformation of the indicator portions remains once the cap is completely removed.

Numerous characteristics and advantages have been set forth in the foregoing description, together with details of structure and function. While the invention has been disclosed in several forms, it will be apparent to those skilled in the art that many modifications, additions, and deletions, especially in matters of shape, size, and arrangement of parts, can be made therein without departing from the spirit and scope of the invention and its equivalents as set forth in the following claims. Therefore, other modifications or embodiments as may be suggested by the teachings herein are particularly reserved as they fall within the breadth and scope of the claims here appended.

What is claimed is:

1. A closure assembly comprising:

a rotational cap comprising:

a top wall and a downward depending skirt, the skirt having an interior side, an exterior side, and a lower edge remote from the top wall; and a tamper-evident ring that is integrally molded to the skirt, the tamper-evident ring being composed of at least two ring segments, each ring segment having a base portion and an indicator portion; and an article forming a tubular neck around a product passage in the article, the neck having an exterior side, a main axis and forming a mouth at a top end of the product passage, the exterior side of the neck and the interior side of the skirt have cooperating first and second screw threads on the neck and skirt respectively;

wherein the rotational cap capable of being secured on the neck of the article, the cap sealing the product passage in a closed position of the cap on the neck, and the cap—for removal of the cap from the neck of the article by a user to open the product passage—being adapted to be manually rotated from the closed position in an opening direction;

wherein the base portion is connected via one or more non-frangible connector portions to the skirt, the base portion extending from a trailing end thereof in the opening direction over a base portion angle about the main axis, the base portion having an inner face with an inner face radius about the main axis;

wherein the indicator portion is integral with the base portion at a junction and extends from the junction in the opening direction over an indicator portion angle about the main axis to a head end of the indicator portion;

wherein the indicator portion is connected at the head end thereof via a frangible bridge to an adjacent trailing end of a base portion of another ring segment;

wherein the article has for each ring segment of the tamper-evident ring a rotation preventing boss, the boss being arranged to be engaged by a corresponding head end of an indicator portion of the segment;

wherein upon rotating the cap in the opening direction by the user from its closed position for the first time, the head end of the indicator portion engages the boss, which then prevents the head end from further motion in the opening direction of the cap, the frangible bridge between the head end and the trailing end of the base portion breaking, and the indicator portion being subjected to permanent deformation;

wherein the boss has a catch portion having a recess at a side of the boss facing the head end of the indicator portion and having an catch portion outer wall with an outer face that is arranged along the inner face of the base portion near the trailing end thereof when the cap is in its closed position;

wherein the head end of the indicator portion is arranged at a spacing radially inward from the trailing end of the adjacent base portion when the cap is in its closed position; and wherein upon rotating the cap in the opening direction by the user from its closed position for the first time, the head end of the indicator portion enters the recess of the catch portion and is then prevented from further motion in the opening direction of the cap, while the catch portion outer wall comes in the spacing between the spaced apart head end and the trailing end, the frangible bridge between the head end and trailing end breaking and the indicator portion manipulated while being subjected to permanent deformation upon further rotation of the cap in the opening direction.

2. The closure assembly of claim 1, wherein the manipulation of the indicator portion is selected from the group consisting of bending, folding, and buckling.

3. A closure assembly comprising:

an article that is injection molded of plastic material and forms a tubular neck around a product passage in the article, the neck having a main axis and forming a mouth at a top end of the product passage, the neck having an exterior side;

a rotational cap that is injection molded of plastic material and capable of being secured on the neck of the article, the cap sealing the product passage in closed position of the cap on the neck, and the cap—for removal of the cap from the neck of the article by a user to open the product passage—being adapted to be manually rotated from the closed position in an opening direction;

wherein the cap comprises a top wall and a downward depending skirt, the skirt having an interior side, an exterior side, and a lower edge remote from the top wall;

wherein the exterior side of the neck and the interior side of the skirt have cooperating first and second screw threads on the neck and skirt respectively;

wherein the cap furthermore comprises a tamper-evident ring that is integrally molded to the skirt, the tamper-evident ring being composed of at least two ring segments, each ring segment having a base portion and an indicator portion;

wherein the base portion is connected via one or more non-frangible connector portions to the skirt, the base portion extending from a trailing end thereof in the opening direction over a base portion angle about the main axis, the base portion having an inner face with an inner face radius about the main axis;

wherein the indicator portion is integral with the base portion at a junction and extends from the junction in the opening direction over an indicator portion angle about the main axis to a head end of the indicator portion;

wherein the indicator portion is connected at the head end thereof via an integrally molded frangible bridge to an adjacent trailing end of a base portion of another ring segment;

wherein the article has for each ring segment of the tamper-evident ring a rotation preventing boss, the boss being arranged to be engaged by a corresponding head end of an indicator portion of the segment;

wherein the cap with tamper-evident ring is embodied such that upon rotating the cap in the opening direction by the user from its closed position for the first time, the head end of the indicator portion engages the boss which then prevents the head end from further motion in the opening direction of the cap, the frangible bridge between the head end and the trailing end of the base portion breaking, and the indicator portion being subjected to permanent deformation;

wherein the boss has a catch portion having a recess at a side of the boss facing the head end of the indicator portion and having an catch portion outer wall with an outer face that is arranged along the inner face of the base portion near the trailing end thereof when the cap is in its closed position;

wherein the head end of the indicator portion is arranged at a spacing radially inward from the trailing end of the adjacent base portion when the cap is in its closed position; and wherein upon rotating the cap in the opening direction by the user from its closed position for the first time—the head end of the indicator portion enters the recess of the catch portion and is then prevented from further motion in the opening direction of the cap, while the catch portion outer wall comes in the spacing between the spaced apart head end and the trailing end, the frangible bridge between the head end and trailing end breaking and the indicator portion being manipulated by one or more of bending, folding, and buckling while being subjected to permanent deformation upon further rotation of the cap in the opening direction.

4. The closure assembly of claim 3, wherein the trailing end of the base portion overlaps the head end in circumferential direction when the cap is in its closed position.

5. The closure assembly of claim 3, wherein the inner face of the base portion lies against the outer face of the catch portion of the boss when the cap is in its closed position.

6. The closure assembly of claim 3, wherein the catch portion is in top view one of U or C-shaped with the catch portion having two legs, wherein one of the legs is formed by the catch portion outer wall and with the recess extending in circumferential direction between the two legs.

7. The closure assembly of claim 3, wherein the indicator portion buckles inwardly towards the neck of the article when the head end is prevented by the catch portion from further rotation with the cap in the opening direction, and the inwardly buckled indicator portion—upon continued rotation of the cap in the opening direction—forcibly passing along the outer face of the catch portion and thereby being folded to extent along the inner face of the base portion.

8. The closure assembly of claim 3, wherein the lower edge of the skirt is provided with downward projecting cap abutment portions each having an abutment face in circumferential direction of the cap; and wherein the bosses are each embodied with an article abutment portion each having an abutment face in circumferential direction, so that upon screwing the cap onto the neck each cap abutment portion abuts with its abutment face in circumferential direction against the corresponding abutment face of an article abutment portion of the boss and thereby defines the closed position of the cap fully screwed onto the neck.

9. The closure assembly of claim 3, wherein the article has two bosses at diametrically opposed positions relative to the neck, and wherein the cap has two ring segments.

10. The closure assembly of claim 3, wherein the article is a fitment to be secured to a container body.

11. The closure assembly of claim 3, wherein the article is a spout, the spout having a lower connector portion adapted to be secured between opposed film walls of a collapsible pouch container.

12. The closure assembly of claim 3, wherein the article has at least a topmost flange on the neck, the one or more flanges each protruding outwardly and extending circumferentially around the neck, and wherein the bosses are raised from the topmost flange.

13. The closure assembly of claim 3, wherein the cap is provided with an annular outer gripping portion that extends generally concentrically about the skirt, the gripping portion being integral with the skirt via a spoke structure.

14. The closure assembly of claim 4, wherein the frangible bridge extends substantially in radial direction between the head end and the trailing end.

15. The closure assembly of claim 7, wherein from the head end towards the junction a major section of the indicator portion is arranged at a smaller radius relative to the main axis than the inner face radius of the base portion, a junction section of the indicator portion extending between the major section and the base portion; and wherein the indicator portion buckles inwardly towards the neck and upon continued rotation of the cap in the opening direction forcibly passing along the outer face of the catch portion and thereby being folded to extent substantially along the inner face of the base portion.

16. The closure assembly of claim 8, wherein the abutment portion of the boss lies between the catch portion of the boss and the neck of the article.

17. The closure assembly of claim 8, wherein each cap abutment portion extends as a semi-circular portion about the main axis and has a lower end face slanting upwards from the lower end of the abutment face.

18. The closure assembly of claim 11, wherein the article is a spout having a lower connector portion with two fins extending in opposed directions, and wherein the spout has a neck, wherein the neck is provided with two bosses at diametrically opposed positions relative to the neck, and wherein the two bosses lie in a plane extending through the two fins, and wherein the cap has two ring segments.

19. The closure assembly of claim 12, wherein the topmost flange extends underneath at least the head end of the indicator portion when the cap is in its closed position.

20. The closure assembly of claim 16, wherein the abutment portion is embodied as a radial rib and wherein the catch portion is embodied as one of a C or U-shaped part with one leg of the part generally transverse to the rib and one leg of the part forming the catch portion outer wall with the recess between the legs.

21. A collapsible pouch container provided with a closure assembly comprising:

a collapsible pouch container comprising a container body having opposed film walls; and a closure assembly comprising a spout that is injection molded of plastic material and a rotational cap that is injection molded of plastic material;

wherein the spout has a lower connector portion that is secured between the opposed film walls, and wherein the spout has a tubular neck around a product passage in the spout, the neck having a main axis and forming a mouth at a top end of the product passage, the neck having an exterior side;

wherein the cap is secured on the neck of the spout, the cap sealing the product passage in closed position of the cap on the neck, and wherein the cap—for removal of the cap from the neck of the article by a user to open the product passage—is adapted to be manually rotated from the closed position in an opening direction;

wherein the cap comprises a top wall and a downward depending skirt, the skirt having an interior side, an exterior side, and a lower edge remote from the top wall;

wherein the exterior side of the neck and the interior side of the skirt have cooperating first and second screw threads on the neck and skirt respectively;

wherein the cap furthermore comprises a tamper-evident ring that is integrally molded to the skirt, the tamper-evident ring being composed of at least two ring segments, each ring segment having a base portion and an indicator portion;

wherein the base portion is connected via one or more non-frangible connector portions to the skirt, the base portion extending from a trailing end thereof in the opening direction over a base portion angle about the main axis, the base portion having an inner face with an inner face radius about the main axis;

wherein the indicator portion is integral with the base portion at a junction and extends from the junction in the opening direction over an indicator portion angle about the main axis to a head end of the indicator portion;

wherein the indicator portion is connected at the head end thereof via an integrally molded frangible bridge to an adjacent trailing end of a base portion of another ring segment;

wherein the spout has for each ring segment of the tamper-evident ring a rotation preventing boss, the boss being arranged to be engaged by a corresponding head end of an indicator portion of the segment;

wherein the cap with tamper-evident ring is embodied such that upon rotating the cap in the opening direction by the user from its closed position for the first time, the head end of the indicator portion engages the boss which then prevents the head end from further motion in the opening direction of the cap, the frangible bridge between the head end and the trailing end of the base portion breaking, and the indicator portion being subjected to permanent deformation;

wherein the boss has a catch portion having a recess at a side of the boss facing the head end of the indicator portion and having an catch portion outer wall with an outer face that is arranged along the inner face of the base portion near the trailing end thereof when the cap is in its closed position;

wherein the head end of the indicator portion is arranged at a spacing radially inward from the trailing end of the adjacent base portion when the cap is in its closed position; and wherein upon rotating the cap in the opening direction by the user from its closed position for the first time—the head end of the indicator portion enters the recess of the catch portion and is then prevented from further motion in the opening direction of the cap, while the catch portion outer wall comes in the spacing between the spaced apart head end and trailing end, the frangible bridge between the head end and trailing end breaking and the indicator portion being manipulated by one or more of bending, folding, and buckling while being subjected to permanent deformation upon further rotation of the cap in the opening direction.

* * * * *